United States Patent [19]

Weber

[11] Patent Number: 4,632,307

[45] Date of Patent: Dec. 30, 1986

[54] ARRANGEMENT FOR FASTENING RAILS TO SLEEPERS

[75] Inventor: Friedhelm Weber, Neuenrade, Fed. Rep. of Germany

[73] Assignee: Vossloh - Werke GmbH, Werdohl, Fed. Rep. of Germany

[21] Appl. No.: 675,539

[22] Filed: Nov. 28, 1984

[51] Int. Cl.[4] ..... F01B 9/04

[52] U.S. Cl. ..... 238/265; 238/283; 238/351

[58] Field of Search ..... 238/310, 338, 342, 349, 238/351, 84, 265, 283, 315, 264

[56] References Cited

U.S. PATENT DOCUMENTS

| | | | |
|---|---|---|---|
| 3,494,558 | 2/1970 | Brown | 238/283 |
| 3,690,551 | 9/1972 | Munch | 238/349 |
| 4,350,291 | 9/1982 | Dobson | 238/349 |
| 4,442,973 | 4/1984 | Fee | 238/349 |
| 4,461,422 | 7/1984 | Harkus | 238/349 X |

FOREIGN PATENT DOCUMENTS

| | | | |
|---|---|---|---|
| 1127928 | 4/1962 | Fed. Rep. of Germany | 238/283 |
| 3243895 | 5/1984 | Fed. Rep. of Germany . | |
| 772821 | 4/1957 | United Kingdom | 238/351 |

*Primary Examiner*—Robert B. Reeves
*Assistant Examiner*—Glenn B. Foster
*Attorney, Agent, or Firm*—James J. Ralabate

[57] ABSTRACT

An arrangement for fastening rails to sleepers includes guide plates (10) disposed to the sides of each rail and elastic clips (20), which may be pressed onto the respective guide plate (10) and onto the foot of the rail by means of bolts (30) anchored in the sleepers, the guide plates (10) having on their upper side in the installed position a rib (13) extending parallel to the rail, on which a part (21) of the elastic clip may be brought to seat as a boundary for the stress path.

In order that the guide plates (10), when made also from plastics, may safely carry without damage the forces exercised by the clips (20), even when there has been an excessive torque on the bolts (30), each rib (13) of the guide plate (10) has a reinforcement (14) in the seating region of the clip (20).

6 Claims, 4 Drawing Figures

FIG. 4
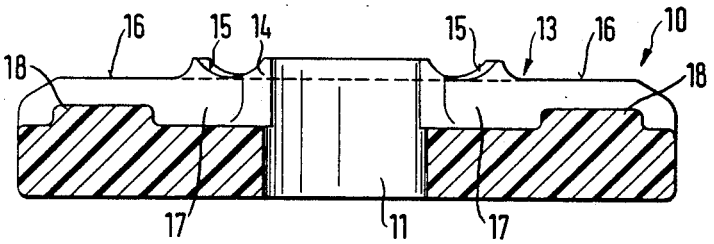
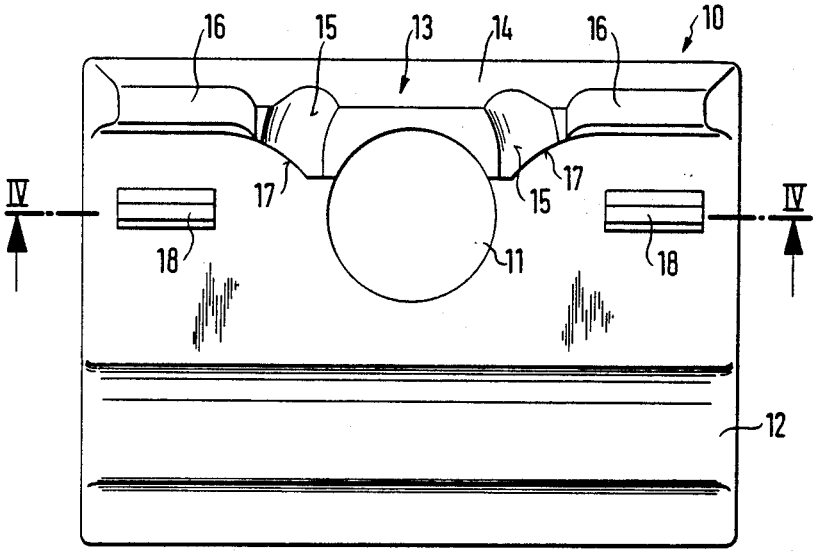
FIG. 3

ARRANGEMENT FOR FASTENING RAILS TO SLEEPERS

This invention concerns an arrangement for fastening rails to sleepers (ties), having guide plates disposed to the sides of the respective rail and elastic clips, which may be pressed onto the guide plate and onto the foot of the rail by means of bolts anchored in the sleepers, the guide plates having on their upper side in the installed position a rib extending parallel to the rail, on which a portion of the elastic clip may be brought to seat as a boundary for the path of stress.

Rail fastenings of this kind have long been known (German Patent Specification Nos. 1,257,817 and 1,261,151) and have proved themselves in widespread use. While the guide plates then used were earlier made from steel, the guide plates have more recently come to be made from plastics. In the use of guide plates of plastics, it has however now been shown that the screwing machines used in the installation of the rails in many instances tighten up the bolts with excessive torque, with the result that in the clips in question, the portion which comes to bear on the rib of the associated guide plate provided for this, as a boundary for the stress path, exercises an increased pressure on the rib of the guide plate, which in extreme cases leads to plastic deformation of the rib or even to tearing of the material of the guide plate.

It is accordingly an object of the invention to provide a fastening arrangement of the kind set out above, in which the guide plates even when made from plastics may safely carry without damage the forces exercised by the clips even in the case of excessive torque.

According to the invention there is provided an arrangement for fastening rails to sleepers, having guide plates disposed to the sides of the respective rail and elastic clips, which may be pressed onto the respective guide plate and onto the foot of the rail by means of bolts anchored in the sleepers, the guide plates having on their upper side in the installed position a rib extending parallel to the rail, on which a part of the elastic clip may be brought to seat as a boundary for the stress path, wherein the rib of the guide plate has a reinforcement in the seating region for the clip.

By virtue of the reinforcement of the rib of the guide plate provided according to the invention, these plates can now safely carry the forces exercised by the stress path boundary portions of the clips, even when the bolts are tightened up with large or excessive torque, the guide plates thus now being able to carry these forces without plastic deformation of the rib or any more extensive damage.

In actual production of the guide plates from plastics, reinforcements of the rib may be achieved on the one hand in a preferred form and on the other hand by means of a simple change in the tools and therefore with acceptable manufacturing costs.

It is therefore advantageous for the reinforcement of the rib of the guide plate in the seating region for the clip to be formed by an enlargement of the cross-section of the rib. It is then preferred that the width of the cross-section of the rib of the guide plate in the seating region for the clip is enlarged compared with the remaining region of the rib. This leads to an enlarged seating surface compared with the known arrangement.

A widening of the cross-section of the rib of the guide plate over its entire length is not possible, at least in those cases in which clips having a W-form are used. The curved middle portion of this clip embraces the shank of the bolt in the installed position and this middle portion comes into contact with the rib of the guide plate, as a stress path boundary, while the bends connecting with the middle portion press onto the guide plate and the free ends connecting with the bends press onto the foot of the rail. These clips have the advantage that they can previously be pre-assembled in the sleeper works together with the other component parts of the fastening arrangement. In this pre-assembly position, the clips are arranged turned through 180° about the shank of the bolt compared with the installed position illustrated. The bends connecting with the middle portion of the respective clip then abut against the rib of the corresponding guide plate. This means however, that a widening of the rib of the guide plates is not possible, since otherwise the bearing of the clip on the rib of the corresponding guide plate in the pre-assembly position could not be achieved.

By means of the enlargement of the cross-section of the rib of the guide plate already described, the guide plate may now carry greater forces from the clip in this region, without a plastic deformation of the rib or even a complete fracture of the material occurring. By virtue of the widening of the cross-section of the rib, the further advantage is obtained that the seating surface of the rib for the part of the clip in question is enlarged with the result that the surface pressure is more favourable, which is of advantage in the case of plastics material in particular.

The enlargement of the cross-section of the rib of the guide plates only in the seating region for the clip has the advantage that the remainder of the guide plate does not need to be altered in regard to its form and dimensions. As a result only insignificant revisions of the tools for the production of the guide plates are required. Furthermore no complicated and expensive acceptance procedure is necessary for the use of the rail fastening according to the invention.

Yet another advantageous feature of the invention consists in the form of the seating surface of the widened part of the rib of the guide plate for the clip corresponding to the form of the part of the clip co-operating with the seating surface. By this measure two advantages are achieved. On the one hand the surface pressure is favourably affected by the conformity of shape aimed at. On the other hand a definite positive securing of the clip to the associated guide plate is achieved, by which the assembly of the rail fastening according to the invention is further facilitated, because the component parts retain the desired position relative to each other prior to the final tightening up of the bolt.

In connection with the rail fastening according to the invention, a clip is preferably used which has a W-form, the curved middle portion of which embraces the bolt in the installed position and comes to bear on the rib of the guide plate as a stress path boundary, while the bends connecting with the middle portion press onto the guide plate and the free ends connecting with the bends press onto the foot of the rail. A clip of this kind is already known. (German Patent Specification No. 1,261,151).

In the use of a clip of this kind it is of advantage that the seating surface of the widened part of the rib of the guide plate corresponds to the region of the middle portion of the clip, with which the seating surface co-operates. Accordingly the seating surface has a concave form in cross-section and also curves along its length. In this way in the installed position, the middle portion of the clip is disposed in the curved and concave form seating face of the widened part of the rib of the guide plate, so that on the one hand a lower surface pressure is achieved and on the other hand the two component parts are secured positively to each other to a positive extent to facilitate the assembly.

A further advantageous embodiment of the rail fastening according to the invention consists in the widened part of the rib of the guide plate having end surfaces, against which the bends connecting with the middle portion of the clip may be brought to bear in the pre-assembly position of the clip, in which the clip is disposed turned through 180° about the axis of the bolt compared with its installed position. By virtue of this construction it is possible to pre-assemble the clip, turned through 180° about the bolt axis compared with the previously mentioned installed position, together with the associated guide plate on the sleeper. In the pre-assembly position, the bends of the clip connecting with the middle portion then abut against the end surfaces of the widened part of the clip of the guide plate from the outside, so that the two components are fully positively secured in the longitudinal direction of the rail, by virtue of which a further simplification of assembly results. The end surfaces mentioned are further necessary as free elements for the pre-assembly in relation to additional ribs, which in the pre-assembly position come to lie within the bends of the clips.

An embodiment of the rail fastening according to the invention will be more fully explained in the following section having regard to the description of the accompanying drawings.

FIG. 3 is a plan view of the guide plate, and

FIG. 4 is a section through the guide plate on the section line IV—IV of FIG. 3.

Figure 1:
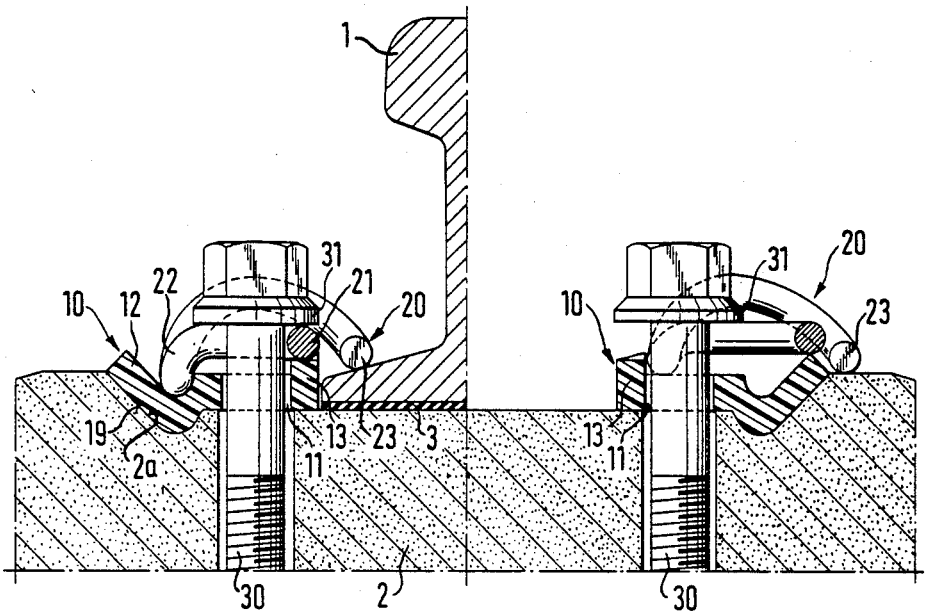
FIG. 1 is a vertical section through the rail fastening, the left-hand portion of the Figure showing the final assembled position and the right-hand portion, the pre-assembly position.

For fastening a rail 1 to a sleeper 2, for example, of concrete, preferably with the interposition of an isolating underlay 3, the fastening arrangement includes a guide plate indicated generally by reference numeral 10. A respective guide plate 10 is disposed on the sleeper 2 on each side of the foot of the rail 1. Each guide plate 10 is in section perpendicular to the rail by virtue of a portion or region formed at an angle, the angle 12 providing an inclined surface 19 leading away from the rail, which comes to bear against a corresponding inclined surface 2*a* of the sleeper 2.

Figure 2:
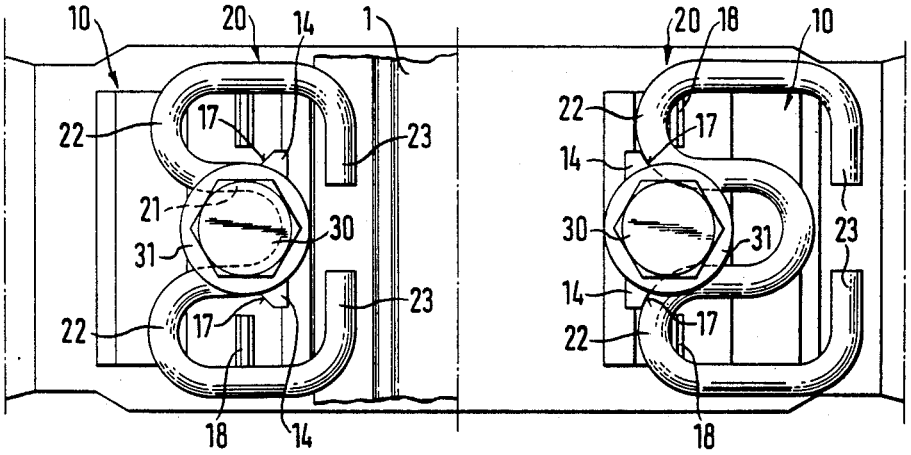
FIG. 2 is a plan view of the arrangement according to FIG. 1 with the final assembled position and the pre-assembly position of the rail fastening.

The rail 1 and the associated guide plates 10 are pressed onto the sleeper 2 by means of a clip of high elasticity indicated generally by reference numeral 20, and also by the action of a bolt 30 extending through a through hole 11 in the guide plate 10, the bolt being anchored in the sleeper 2 and a further washer 31 being optionally disposed under the head of the bolt. The clip 20 has a substantially W-shape. In its installed position, as can be seen from the left-hand side illustrations of FIGS. 1 and 2, the curved middle portion 21 of the clip 20 embraces the shank of the bolt 30 while the bends 22 connecting with the middle portion 21 press onto the guide plate 10 in the region of the angle 12 and the free ends 23 connecting with the bends press onto the foot of the rail 1. In this way, the horizontal forces transferred to the guide plates 10 from the rail 1 by means of the inclined surface 19 of the guide plate 10, can be taken up by the inclined surface 2*a* of the sleeper and thereby into the sleeper itself.

Each guide plate 10 further has a rib 13 extending parallel to the rail 2 in the installed position, wihch is formed on the upper surface of the guide plate 10 in the vicinity of the region which is directed towards the foot of the rail 1 in the installed position. This rib 13 forms, as a stress path boundary for the clip 20, a seating surface 15 for the middle portion 21 of the clip 20, which presses onto the rib 13 of the guide plate 10 when the clip is stressed to its maximum extend, as can best be seen in the left-hand representation of FIG. 1.

As can now best be seen from FIGS. 3 and 4, the rib 13 of the guide plate 10 has, in the region in which the middle portion 21 of the clip 20 comes to rest, i.e. in the region of the through hole 11, a reinforcement 14. This reinforcement 14 is formed by a broadening perpendicular to the run of the rib of the rib 13 in relation to its other regions 16. The correspondingly enlarged seating surface 15 of the widened part 14 of the rib 13 of the guide plate 10 for the middle portion 21 of the clip 20, i.e. that surface which extends parallel to the plane of the main extent of the guide plate, has a shape which corresponds to that portion, namely the middle portion 21, of the clip 20, which comes to bear on this seating surface 15. Since in the case in question, the clip 20 is bent from circular section steel, the seating surface 15 of the widened part 14 of the rib 13 has the form of a curvedly extending channel or groove, the shape of which therefore corresponds to the shape of the circular section steel and the extent of which corresponds to the extent of the middle part 21 of the clip 20. As can best be seen from the left-hand representation of FIG. 2, there results from this form or shape of the seating surface 15 of the widened part of the rib 14 of the guide plate 10, a contact of the middle portion 21 of the clip 20 on the correspondingly enlarged seating surface 15 of the rib 13 of the guide plate 10 over a large area, with the result that the surface pressure is low even when there are large bearing pressures by the clip 20 on the guide plate 10.

The widened part 14 of the rib 13 of the guide plate 10 also has end surfaces 10, which are directed perpendicular to the plane of the main extent of the guide plate 10 and in section in this plane are formed somewhat curved. In this way, in the pre-assembly position of the clip 20, in which the clip is disposed turned through 180° about the bolt axis with respect to the assembled position, this being best seen in the right-hand representation of FIG. 2, the bends 22 of the clip 20 come to rest on the end surfaces 17, by which in the pre-assembly position, a kind of positive connection is achieved between the clip and the guide plate in a direction parallel to the rail. In this way ease of mounting for the pre-assembly of the rail-fastening in the sleeper factory is achieved, because the two parts are already somewhat secured to each other, without the clip having previously been stressed against the guide plate 10 by tightening the nut of the bolt 20. Two short additional ribs 18 on the upper surface of the guide plate 10 serve the same purpose. These extend parallel to the rib 13 at a spacing from it. These additional ribs 18 are disposed within the bends 22 of the clip 20 in the pre-assembly position, as can be seen from the right-hand representation of FIG. 2.

I claim:

1. An arrangement for fastening rails to sleepers, having bolt means, guide plates adapted to be disposed to the sides of the respective rail, and substantially w-shaped elastic clips, said clips independent of any other structure in said arrangement, said guide plates and said clips adapted to be connected by said bolt means, the lower surface of the guide plate similarly contoured to the upper surface of the sleeper to prevent lateral motion of the guide plate with respect to the sleeper, said guide plates having a rib on their upper side extending parallel to the rail on the side of the guideplate between the bolt means and the rail, a curved middle portion of said w-shaped clip adapted to embrace a shank of said bolt means when pressed into said guide plate in the installed position, said middle portion when in the installed position adapted to seat and come in contact with the rib of said guide plate as a boundary for the stress path, and wherein the width of the cross-section of the rib is a seating region for the clip wherein the clip contacts and exerts pressure upon a portion of the guideplate on the opposite side of the bolt from the rail, the inside of the rib portion of said guide plate closely aligned with the mating rails to prevent lateral motion of said rail with respect to the sleeper.

2. An arrangement according to claim 1 wherein the shape of the seating surface of the widened part of the rib of the guide plate for the clip corresponds to the contact surface of the part of the clip which cooperates with the seating surface.

3. An arrangement according to claim 2 in which the clip has a substantially W-shape and the curved middle portion of the clip embraces the shank of the bolt in the installed position and this middle portion comes into contact with the rib of the guide plate as a boundary for the stress path, while the bends connecting with the middle portion press onto the guide plate and the free ends connecting with the bends press onto the foot of the rail, and the seating surface of the widened part of the rib of the guide plate corresponds to the region of the middle portion of the clip which co-operates with the seating surface.

4. An arrangement according to claim 3 wherein the seating surface of the rib is curved along its length and is concave in its cross-section.

5. An arrangement according to claim 3 wherein the widened part of the rib of the guide plate has end surfaces, against which the bends of the clip connecting with the middle portion may be brought to bear in the pre-assembly position of the clip, in which it is disposed turned through 180° about the axis of the bolt with respect to the installed position.

6. A guide plate for an arrangement for fastening rails to sleepers according to claim 1.

* * * * *